US007312414B2

(12) United States Patent
Yatsu et al.

(10) Patent No.: US 7,312,414 B2
(45) Date of Patent: Dec. 25, 2007

(54) KEY SWITCH DEVICE

(75) Inventors: Nobuo Yatsu, Shinagawa (JP); Satoshi Sakurai, Shinagawa (JP); Nobuyoshi Shimizu, Shinagawa (JP); Takashi Arita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/648,531

(22) Filed: Jan. 3, 2007

(65) Prior Publication Data

US 2007/0158172 A1 Jul. 12, 2007

(30) Foreign Application Priority Data

Jan. 11, 2006 (JP) ..... 2006-003989

(51) Int. Cl.
*H01H 13/70* (2006.01)

(52) U.S. Cl. ..... 200/344

(58) Field of Classification Search ..... 200/5 A, 200/517, 344, 345; 341/22; 345/168, 169; 400/490, 491, 491.2, 495, 495.1, 496
See application file for complete search history.

(56) References Cited

U.S. PATENT DOCUMENTS 5,657,860 A * 8/1997 Koike et al. ..... 200/344
5,997,196 A * 12/1999 Hu ..... 400/495
6,004,051 A * 12/1999 Hu ..... 400/491.2
6,257,782 B1 * 7/2001 Maruyama et al. ..... 400/495.1
6,455,794 B2 * 9/2002 Sato et al. ..... 200/344
6,586,695 B2 * 7/2003 Sato et al. ..... 200/344
6,812,421 B2 * 11/2004 Sato et al. ..... 200/344

FOREIGN PATENT DOCUMENTS

JP 9-190735 7/1997
JP 2001-283676 10/2001
JP 2003-092041 3/2003

* cited by examiner

*Primary Examiner*—Michael A Friedhofer
(74) *Attorney, Agent, or Firm*—Staas & Halsey LLP

(57) ABSTRACT

A key switch device capable of preventing a key top from displacing in the horizontal direction when the key top is being depressed, and of minimizing wear and damage to the components thereof. A displacement restricting part, contacting each of a pair of link members, is formed by punching and bending a support plate. Further, on the back side of a trunk of each link member, an engaging portion capable of contacting the displacement restricting part is formed. When the key top is being depressed, the displacement restricting part always contacts the engaging portion, whereby the displacement of the link members in the horizontal direction or the slipping movement of the key top may be prevented.

23 Claims, 11 Drawing Sheets

KEY SWITCH DEVICE

RELATED APPLICATIONS

The present application claims priority from Japanese Patent Application No. 2006-3989, filed on Jan. 11, 2006, the entire content of which is fully incorporated herein by reference.

BACKGROUND OF THE INVENTION

1. Field of the Invention

The present invention relates generally to a switch configuration for key-entry operation and, more particularly, to a key-entry switch device (hereinafter referred to as a key switch) preferably used for a keyboard incorporated, as an input device, in electronic equipment. The present invention also relates to a keyboard provided with a plurality of key switches.

2. Description of the Related Art

In a thinner or a low-profile-type keyboard for a portable electronic apparatus, such as a notebook-type personal computer, it is required to reduce the height of a key switch for a key-entry operation as well as to improve the operability of the key switch.

As a key switch device for such a low-profile-type keyboard, for example, Japanese Unexamined Patent Publication No. 9-190735 discloses a key switch device including a base plate, a key top arranged on the base plate, a pair of link members interlocked to each other to support the key top above the base plate and direct the key top in a vertical or up-and-down direction, and a switch like a sheet (hereinafter referred to as a membrane switch sheet) capable of opening and closing a contact of an electronic circuit in accordance with the vertical or up-and-down movement of the key top. The pair of link members are assembled together into a reverse V-shape as seen in a lateral direction (or in a side view) and meshed at toothed end regions formed on one ends thereof with each other such that the pair of link members may pivot relative to the key top. Further, the pair of link members slidably engage with the base plate at the other ends thereof.

When the pair of link members pivot at one ends thereof in the opposite direction each other such that the other ends thereof are horizontally moved along the base plate, the key top is movable substantially in the vertical direction relative to the base plate, while keeping a predetermined posture of the key top.

In the above key switch device, the key top is moved in the vertical direction while the key top is parallel to the base plate. FIGS. 16*a*-16*c* are views explaining the motion of a key top 714 in the vertical direction of a key switch device 710. When the key top 714 is positioned at an uppermost position as shown in FIG. 16*a*, each sliding portion 746 of a pair of link members 716 contacts one end portion of each groove 750 of guiding sections 748. Therefore, as the link members 716 can not be moved in the sliding direction (in the horizontal direction in FIG. 16*a*), the key top 714 can not be also moved in the horizontal direction. When the key top 714 is positioned at a lowermost position as shown in FIG. 16*c*, each sliding portion 746 contacts another end portion of each groove 750, the key top 714 also can not be moved in the horizontal direction.

However, when the key top 714 is between the uppermost and lowermost positions as shown in FIG. 16*b*, each sliding portion 746 may be moved in the horizontal direction (as indicated by arrows in FIG. 16*b*) in each groove 750.

Therefore, in the state of FIG. 16*b* (i.e., while the key top is being pressed), the key top 714 may be somewhat displaced in the horizontal direction. This may cause the instability or a slipping movement of the key top, resulting in the deterioration of the operability of the key top.

On the other hand, the key top is firmly held in the direction perpendicular to the drawing, by the stiffness of the link members, during the vertical motion of the key top. However, the displacement of the key top in the horizontal direction is restricted only by the elasticity of an actuating member made from an elastic body such as a rubber arranged between the key top and the membrane switch sheet. Therefore, the key top can not be sufficiently held in the horizontal direction.

In order to resolve the above problem, for example, Japanese Unexamined Patent Publication No. 2001-283676 discloses a shaft of a link provided with a projection having an oval cross section and an opening, with which the projection may be slidably engaged, having one end positioned above the other end. In this constitution, the shaft having the oval cross section is slidably engaged with the opening having the height which varies depending on the horizontal position, whereby a key top cannot bounce or cannot be displaced in the horizontal direction. Therefore, it is necessary to manufacture the projection and the opening with high dimensional accuracy. However, due to wear between the projection and the opening, the gap between them is gradually increased, whereby the effect for avoiding the displacement of the key top in the horizontal direction may be reduced. Further, as the oval cross section of the projection is relatively small, the projection may be easily damaged due to the low stiffness thereof.

Further, Japanese Unexamined Patent Publication No. 2003-92041 discloses a key switch device including a wall member abutting against a pinching axle of a link member. In the device, the pinching axle and the wall member cooperate so as to limit the displacement of a key top in the horizontal direction. However, both of the pinching axle and the wall member are relatively small projections and, the contacting area between them is considerably small. Therefore, also this constitution, similarly to the case of Japanese Unexamined Patent Publication No. 2001-283676, is somewhat insufficient from the viewpoint of the stiffness and the wear property of each component.

SUMMARY OF THE INVENTION

It is an object of the present invention to provide a key switch device, capable of avoiding the displacement of a key top in the horizontal direction, while minimizing the affection of wear generated in the key switch device.

To this end, according to one aspect of the present invention, there is provided a key switch device a key switch device comprising: a support plate; a key top arranged above the support plate; a pair of link members interlocked to each other to support the key top above the support plate and direct the key top in a vertical direction; and a switch mechanism capable of opening and closing a contact section of an electric circuit in accordance with the vertical movement of the key top, wherein each of the pair of link members has a toothed end such that the link members are assembled together into a reverse V-shape as seen in a lateral direction, and a sliding part is slidably engaged with the support plate, wherein the switch mechanism includes a membrane switch sheet carrying the contact section at a position corresponding to the key top and placed on the support plate, wherein the support plate has a displacement restricting part arranged on the support plate, and wherein each of the pair of link members has an engaging part configured to contact the displacement restricting part at any time during the vertical movement of the key top, whereby the displacement of the key top in the sliding direction of the sliding part of each of the pair of link members is restricted.

Concretely, the support plate is made from a metal plate and the displacement restricting part is formed by punching and bending a part of the metal plate and has a curved surface contacting the engaging portion of each of the pair of link members. Alternatively, the support plate may be made from a metal plate and the displacement restricting part is formed by punching and bending a part of the metal plate and has an arc-shaped cut surface contacting the engaging portion of each of the pair of link members.

Preferably, each of the pair of link members has two arm portions and a body portion coupling the two arm portions, and the engaging part includes a curved concave portion and a curved convex portion formed on the body portion. Further, it is preferable that the convex portion of the engaging part has a cross section of a part of an ellipse as seen in the lateral direction, and wherein the displacement restricting part has a curved surface having an arc-shaped cross section as seen in the lateral direction.

Preferably, the engaging part is formed on either side of the body portion of each of the pair of link members.

The support plate may be made from a metal plate and the displacement restricting part is formed by punching and bending a part of the metal plate, and displacement restricting part may have a protrusion slidably engaged with a groove formed on each of the pair of link members. In this case, the protrusion is preferably formed by bending a part of the displacement restricting part formed by punching and bending a part of the metal plate.

According to another aspect of the present invention, there is provided a key switch device comprising: a support plate; a key top arranged above the support plate; a pair of link members interlocked to each other to support the key top above the support plate and direct the key top in a vertical direction; and a switch mechanism capable of opening and closing a contact section of an electric circuit in accordance with the vertical movement of the key top, wherein each of the pair of link members has a toothed end such that the link members are assembled together into a reverse V-shape as seen in a lateral direction, and a sliding part is slidably engaged with the support plate, wherein the switch mechanism includes a membrane switch sheet carrying the contact section at a position corresponding to the key top and placed on the support plate, wherein the support plate has a blade spring arranged on the support plate and having an end biased against the key top, and wherein the key top engages with the end of the blade spring and has a protrusion on the lower face thereof for guiding the end of the blade spring such that the movement of the sliding part in the sliding direction thereof relative to the key top is restricted.

Preferably, the blade spring is formed by punching and bending a part of the support plate.

According to still another aspect of the present invention, there is provided a key switch device comprising: a support plate; a key top arranged above the support plate; a first pair of link members interlocked to each other to support the key top above the support plate and direct the key top in a vertical direction; and a switch mechanism capable of opening and closing a contact section of an electric circuit in accordance with the vertical movement of the key top, wherein each of the first pair of link members has a toothed end such that the first link members are assembled together into a reverse V-shape as seen in a lateral direction, and a sliding part is slidably engaged with the support plate, wherein the switch mechanism includes a membrane switch sheet carrying the contact section at a position corresponding to the key top and placed on the support plate, and wherein the key switch device further comprises a second pair of link members having a second sliding part slidably engaged with the support plate such that the second sliding part may move relative to the support plate in the direction generally perpendicular to the sliding direction of each sliding part of the first pair of link members.

According to still another aspect of the present invention, there is provided a key switch device comprising: a support plate; a key top arranged above the support plate; a first pair of link members interlocked to each other to support the key top above the support plate and direct the key top in a vertical direction; and a switch mechanism capable of opening and closing a contact section of an electric circuit in accordance with the vertical movement of the key top, wherein each of the first pair of link members has a toothed end such that the first link members are assembled together into a reverse V-shape as seen in a lateral direction, and a sliding part is slidably engaged with the support plate, wherein the switch mechanism includes a membrane switch sheet carrying the contact section at a position corresponding to the key top and placed on the support plate, and wherein the switch mechanism comprises an actuating member arranged between the key top and the membrane switch sheet and configured to close the contact when the key top is downwardly moved, the actuating member having a displacement restricting part for limiting the displacement of the top of the actuating member in the sliding direction of the sliding part.

Preferably, the displacement restricting part is a wall portion integrally formed on the bottom of the actuating member.

The actuating member may have the shape of a truncated pyramid. Alternatively, the actuating member may have the shape of a truncated pyramid the two side walls of which, opposing in the sliding direction of the sliding part, are removed.

According to still another aspect of the present invention, there is provided a key switch device comprising: a support plate; a key top arranged above the support plate; a first pair of link members interlocked to each other to support the key top above the support plate and direct the key top in a vertical direction; and a switch mechanism capable of opening and closing a contact section of an electric circuit in accordance with the vertical movement of the key top, wherein each of the first pair of link members has a toothed end such that the first link members are assembled together into a V-shape as seen in a lateral direction, and a sliding part is slidably engaged with a guiding part arranged on the lower surface of the key top, wherein the switch mechanism includes a membrane switch sheet carrying the contact section at a position corresponding to the key top and placed on the support plate, and wherein the guiding part on the lower surface of the key top has a guiding groove the width of which is not constant along the sliding direction of the sliding part, the sliding part being configured such that the shape of the cross section of a part of the sliding part engaging with the guiding groove is changed corresponding to the width of the guiding groove.

The sliding part may have the shape of a circular cone or a truncated cone. Alternatively, the sliding part may have the shape of a circular cone or a truncated cone a side wall of which is twisted.

According to a further aspect of the present invention, there is provided a key board having a plurality of key switch devices of the invention.

BRIEF DESCRIPTION OF THE DRAWINGS

The above and other objects, features and advantages of the present invention will become more apparent from the following description of preferred embodiments in connection with the accompanying drawings, wherein.

DESCRIPTION OF THE PREFERRED EMBODIMENT

The embodiments of the present invention are described below in detail, with reference to the accompanying drawings.

Figure 1:
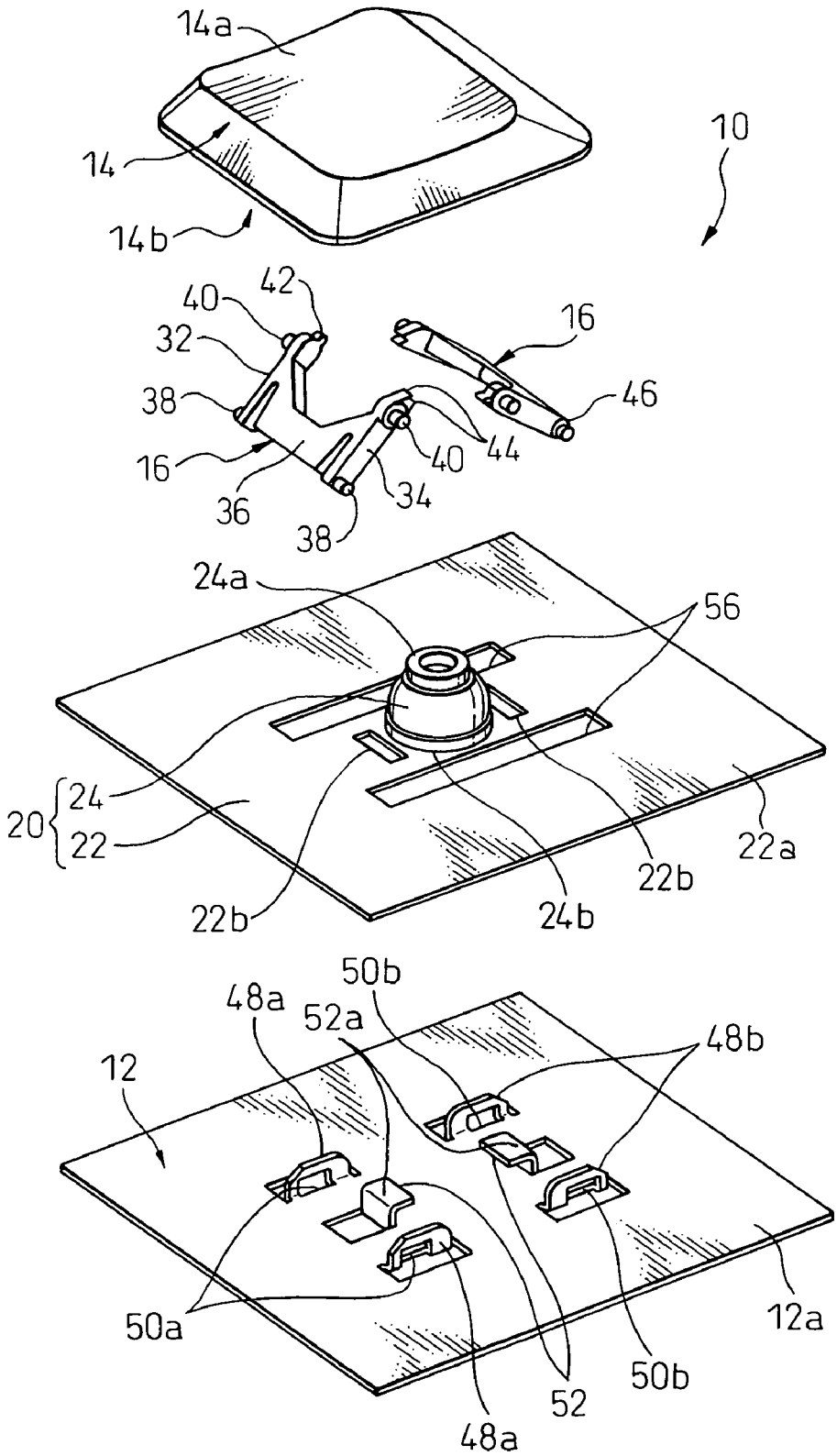
FIG. 1 is an exploded perspective view showing a key switch device according to a first embodiment of the present invention.

FIG. 1 is an exploded perspective view showing a key switch device 10 according to a first embodiment of the invention. The key switch 10 includes a support plate 12, a key top 14 arranged above the support plate 12, a pair of link members 16 interlocked to each other to support the key top 14 above the support plate 12 and direct the key top 14 in a vertical or up-and-down direction, and a switch mechanism 20 capable of opening and closing a contact section 18 (FIGS. 2*a* to 2*d*) of an electric circuit in accordance with the vertical or up-and-down movement of the key top 14. The switch mechanism 20 includes a membrane switch sheet 22 carrying the contact section 18 at a position corresponding to the key top 14 and placed on the support plate 12, and an actuating member 24 disposed between the key top 14 and the membrane switch sheet 22 and acting to close the contact section 18 in accordance with the lowering movement of the key top 14. The support plate 12 is a rigid member in the shape of a flat plate, such as a separate thin metal plate formed of a sheet metal material. The support plate 12 acts to support, on the generally flat upper surface 12*a* thereof, the membrane switch sheet 22 and the actuating member 24 in a stationary state.

Figure 2A:
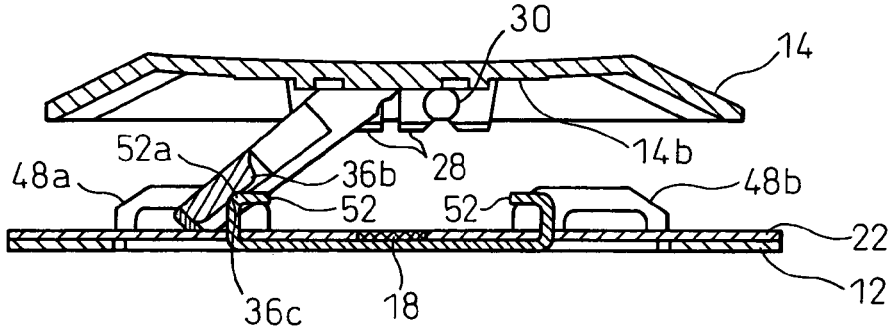
FIG. 2*a* is a sectional view, explaining the function of a displacement restricting part of the key switch, showing a key top at the uppermost position thereof.

The key top 14 is a dish-like member having a generally rectangular shape as seen in a plan view and, e.g., integrally molded into a unitary member from a resinous material, and includes an operating surface 14*a* subjected to a key-entry operation and an inner surface 14*b* opposite to the operating surface 14*a*. As shown in FIG. 2*a*, two pairs of pivot-support sections 28 having a mutually identical structure are formed on the inner surface 14*b* of the key top 14, and are arranged side-by-side in a link sliding direction (a rightward/leftward direction in FIG. 2*a*). Two pivot-support sections 28 constituting each pair are disposed at a generally center region of the inner surface 14*b* of the key top 14 as seen in the link sliding direction, and are spaced from each other by a distance permitting a second end region of each link member 16, to be inserted therebetween. Each of a pair of link members 16 is pivotally joined, at a pivoting part provided in the second end region, to each pivot-support section 28.

A pair of link members 16 have shapes and dimensions identical to each other, and are assembled together into a reverse V-shape as seen in a lateral direction or a side view, and meshed at one end regions thereof with each other in a geared manner. Each link member 16 is formed as, e.g., an integrally molded unitary piece made of a resinous material. The link member 16 integrally includes a pair of arms 32, 34 extending generally parallel to each other and a trunk 36 interconnecting the arms 32, 34 with each other. In the illustrated embodiment, in each of the link members 16, the end regions of the arms 32, 34 adjoining the trunk 36 are defined as a first end region of the link member 16, and the end regions of the arms 32, 34 extending in the same direction from the trunk 36 are defined as a second end region of the link member 16.

In the first end region of each link member 16, a pair of sliding axles 38 constituting a sliding part project coaxially with each other from the mutually facing-away outer sides of the arms 32, 34 and oppositely to the trunk 36. In the second end region of each link member 16, a pair of pivoting axles 40 project coaxially with each other from the outer sides of the arms 32, 34 in the same direction as the sliding axles 38. Further, on one arm 32 of each link member 16, a tooth 42 is provided on the distal end surface of the second end region near the pivoting axis 40, and on the other arm 34, two teeth 44 are provided on the distal end surface of the second end region near the pivoting axis 40. In each link member 16, the end regions (or the first end region) of the arms 32, 34, including the sliding axles 38, constitute a sliding part 46 and are engaged with two pairs of guiding parts 48*a*, 48*b* arranged on the support plate 12. Each guiding part of each pair is, for example, a plate piece formed by punching and bending a part of the support plate 12 and are spaced from each other by a distance permitting the first end region of each link member 16 to be inserted therebetween. The sliding parts 46 of the first end region of each link member 16 are slidably engaged with a guiding grooves 50*a*, 50*b* of the guiding parts 48*a*, 48*b*, by means of the sliding axles 38.

Each of the link members 16 is disposed between the support plate 12 and the key top 14 with, as described above, the sliding axles 38 provided in the first end region slidably fitted into the guide grooves 50*a*, 50*b* of the respective guide parts 48*a*, 48*b* of the support plate 12, and with the pivoting axles 40 provided in the second end region pivotally fitted into bearing holes 30 of the respective pivot-support sections 28 of the key top 14. The pair of link members 16 are configured to be rotatable in a mutually interlocking manner, through an interlocking structure formed by intermeshing one tooth 42 of the respective one arm 32 with two teeth 44 of the respective other arm 34 thereof, about respective pivot axes defined by the pivoting axles 40 of the arms 32, 34.

Therefore, when the link members 16 synchronously rotate in opposite directions about respective pivot axes and the respective sliding parts 46 slide in a generally horizontal direction under the guiding action of the corresponding guide parts 48*a*, 48*b* on the support plate 12 (i.e., under the sliding engagement of the sliding axle 38 with the guiding groove 50*a* or 50*b*), the key top 14 is subjected to a parallel displacement in a generally vertical direction relative to the support plate 12, while keeping a predetermined, generally-horizontal posture of the key top 14 wherein the operating surface 14*a* is substantially parallel to the upper surface 12*a* of the support plate 12. As the key top 14 descends from the uppermost position thereof, the sliding parts 46 of the link members 16 slide, under the guiding action of the associated guide parts 48*a*, 48*b*, away from each other in a direction generally perpendicular to the direction of vertical movement of the key top 14. When the key top 14 reaches the lowermost position of the keying stroke, the contact section 18 of the switch mechanism 20 is closed.

The actuating member 24 of the switch mechanism 20, which is a dome-shaped member integrally molded into a unitary piece from a rubber material, is fixed to the membrane switch sheet 22 at a bottom dome-shaped end 24*b* thereof, with a dome top 24*a* facing toward the key top 14. When no load is applied to the actuating member 24, the dome top 24*a* of the actuating member 24 is upwardly spaced from the membrane switch sheet 22. On the inner surface of the dome top 24*a* of the actuating member 24, a protrusion (FIGS. 9*a* to 9*c*) is formed to be aligned to the contact section 18 of the membrane switch sheet 22 for pressing and closing the contact section 18 when the key top 14 is depressed.

In the key switch 10, when no external force is applied to the key top 14, the actuating member 24 of the switch mechanism 20 biases the key top 14 toward, and supports it, by the dome top 24*a*, in the uppermost position of the stroke vertically above the support plate 12. At this time, the contact section 18 of the membrane switch sheet 22 is in an opened state. When the key top 14 is depressed by an key-entry operation, the actuating member 24 is deformed while exerting an elastic biasing force to the key top 14 in an upward direction and, just before the key top 14 reaches the lowermost position of the stroke, the actuating member 24 presses the membrane switch sheet 22 from the outside thereof with the protrusion on the inner surface so as to close the contact section 18. When the depressing force upon the key top 14 is released, the actuating member 24 is elastically restored so as to return the key top 14 to the uppermost position and, thereby, the membrane switch sheet 22 is restored to open the contact section 18.

The actuating member 24 is elastically deformed in a buckling mode due to the dome shape thereof (FIGS. 9*a* to 9*c*), in accordance with a key-entry operation, whereby an elastic biasing force is exerted to the key top 14, which assumes non-linear relationship with a vertical displacement of the key top 14. As a result, the key switch 10 can establish unique key-entry operating properties, accompanied by a so-called click feeling, such that, at the instant the amount of depression of the key top 14 exceeds a predetermined value, the biasing force in a return direction, which has gradually increased until that time, is sharply reduced.

In the key switch 10, the membrane switch sheet 22 is provided with through-holes 56 at regions corresponding to the two pairs of guide sections 48*a*, 48*b* of the support plate 12. The sliding part 46 of each link member 16 (i.e., portions around the sliding axles 38 of the arms 32, 34) passes through the associated through-holes 56 of the membrane switch sheet 22, and are placed slidably on the upper surface 12*a* of the support plate 12. Each link member 16 operates in a sliding manner, over the entire stroke of the vertical movement of the key top 14, and the sliding part 46 passes through the through-hole 56 of the membrane switch sheet 22 and slides along the upper surface 12*a* of the support plate 12. Thus, each through-hole 56 is formed, in the membrane switch sheet 22 along the sliding path of the sliding parts 46 of a pair of link members 16, into dimensions and a shape so as not to prevent the sliding movement.

Figure 3:
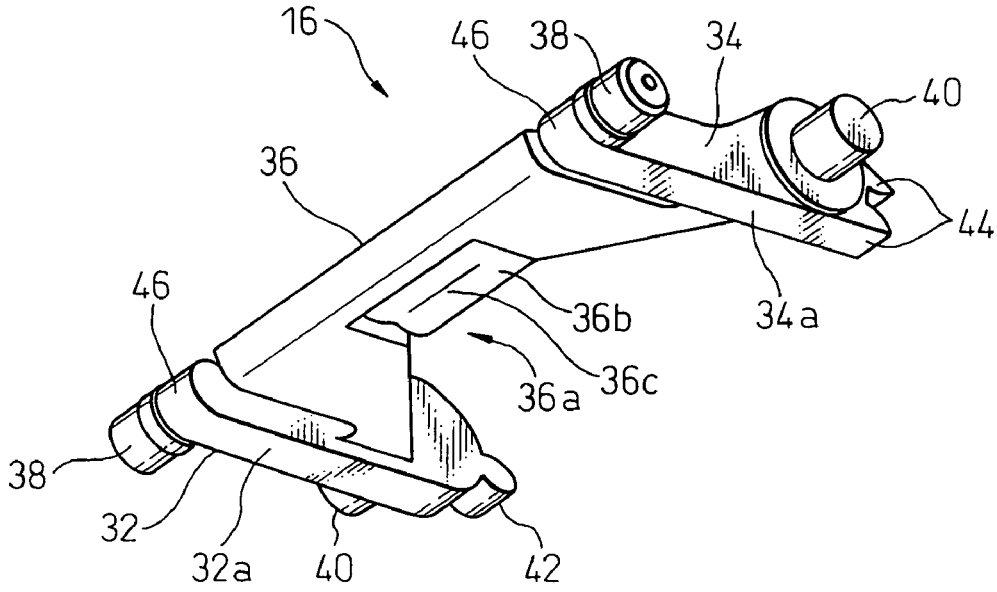
FIG. 3 is a perspective view of a link member of the key switch device.

The feature of the above the first embodiment is that, as shown in FIG. 1, displacement restricting parts 52 each contacting the trunk 36 of the link member 16 are arranged on the support plate 12 and, further, an engaging portion 36*a* contacting the displacement restricting part 52 are formed on the back side (or the side facing downward) of the trunk 36, as shown if FIG. 3. Accordingly, an opening 22*b* is formed in the membrane switch sheet 22 through which the displacement restricting part 52 may extend when assembling. From the viewpoint of easy manufacturing, it is advantageous that each displacement restricting part 52 is formed by punching and bending a part of the support plate 12, similarly to the guiding parts 48*a*, 48*b*.

Figure 2B:
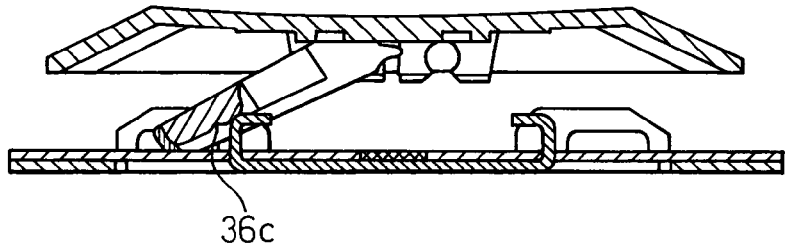
FIG. 2*b* shows the state in which the key top is somewhat lowered from the state of FIG. 2*a;*
Figure 2C:
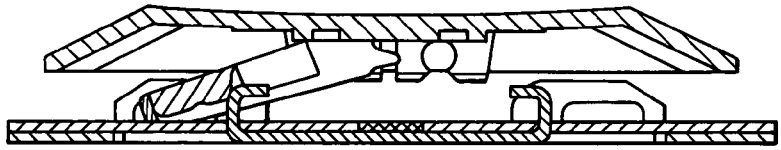
FIG. 2*c* shows the state in which the key top is further lowered from the state of FIG. 2*b;*
Figure 2D:
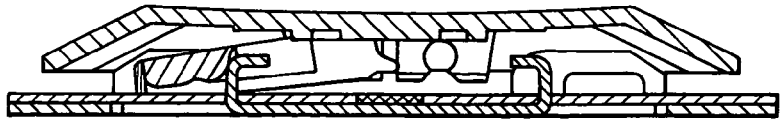
FIG. 2*d* shows the key top at the lowermost position thereof.

Next, the function of the displacement restricting part 52 will be explained. As shown in FIG. 3, the engaging portion 36*a* of the trunk 36 has a curved convex portion 36*b* and a curved concave portion 36*c*. As shown in FIG. 2*a*, when the key top 14 is positioned at the uppermost position, a convex portion 52*a* of the displacement restricting part 52 contacts the concave portion 36*c* of the trunk 36. While the key top 14 is gradually lowered, as shown in FIG. 2*b*, the curved portion 52*a* slides on from the concave portion 36*c* to the convex portion 36*b*. In the state of FIG. 2*c*, the key top 14 is further lowered while the curved portion 52*a* contacts the convex portion 36*b*. Finally, the key top reaches the lowermost position as shown in FIG. 2*d*. In this way, as the displacement restricting part 52 always contacts the engaging portion of the trunk 36 while the key top 14 is lowered from the uppermost position to the lowermost position, the displacement in the rightward/leftward direction or the slipping movement of the key top 14 is prevented, whereby the stable key-entry operation may be possible. Further, as the engaging portion 36*a* is constituted by the curved convex and concave portions, the key top at the uppermost position (FIG. 2*a*) may be stable. In addition, FIGS. 2*a* to 2*d* illustrate the link member 16 at one side (or the left side) only, however, the link member at the right side may be similarly constituted.

The shapes of the curved portion 52*a* of the displacement restricting part 52 and the convex portion 36*b* of the trunk 36 may be any shapes, insofar as the above effect is achieved. As a preferred example, the curved portion 52*a* and the convex portion 36*b* have an arc shape and a part of an ellipse shape, respectively, as seen in the lateral direction. As the curved portion 52*a* is a member having a width formed by punching and bending a part of the support plate, as shown in FIG. 1, the engaging portion 36*a* of the trunk 36 may have a length corresponding to the width of the curved portion 52*a*. Therefore, the contact area between the displacement restricting part 52 and the engaging portion 36*a* may be considerably large and the maximum length may be up to the length of the trunk 36. Due to this, a rigid and tough mechanism for preventing the slipping displacement may be realized and the mechanism is hardly subjected to wear.

Figure 4:
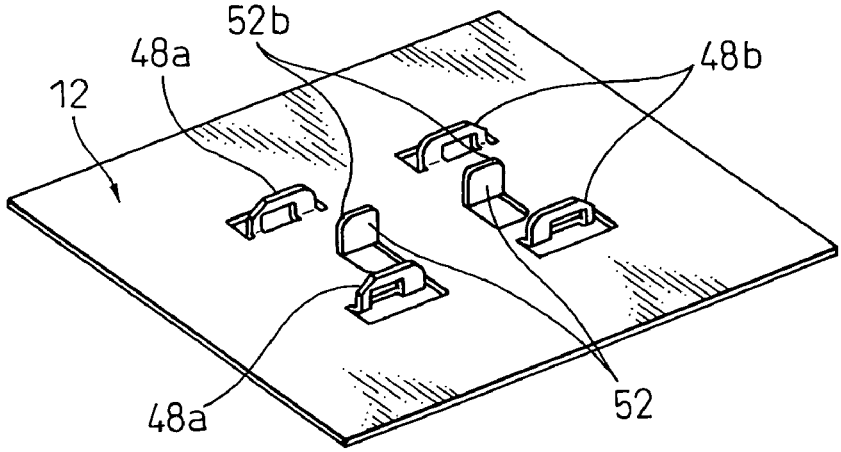
FIG. 4 shows another configuration of the displacement restricting part arranged on a support plate.

The displacement restricting part 52 may also be formed, as shown in FIG. 4, such that a cut surface 52*b* having an arc shape may slidably contact the engaging portion 36*a* of the trunk 36. In this case, however, the contact area between the displacement restricting part 52 and the engaging portion 36*a* may be smaller than in the case using the curved portion 52*a*. Therefore, the embodiment as shown in FIG. 1 is more advantageous from the viewpoint of wear.

In the illustrated embodiment, the engaging portion 36*a* is formed on only one side of the trunk 36. However, the engaging portion 36*a* may be formed on both sides of the trunk 36. In this case, it is unnecessary to pay attention to the orientation of each link member when assembling the key switch device.

In the key switch 10, a base panel, which is conventionally used on the membrane sheet 22, is omitted. Therefore, the thickness of the key switch device 10 as a whole may be reduced. Further, the displacement restricting part 52 formed by punching and bending a part of the support plate 12, similarly to the guiding parts 48*a*, 48*b*, cannot be an impediment to reducing the thickness of the key switch device and producing the device at low cost. However, the displacement restricting part may be formed integrally with the support plate by another method, for example, resinous molding, metal die-cast molding or metal injection molding. Otherwise, the displacement restricting part may be independently produced and attached to the support plate.

Figure 5A:
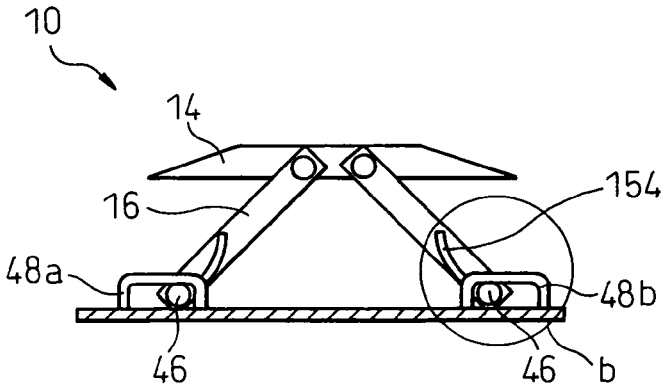
FIG. 5*a* is a schematic side view showing a major part of a key switch device according to a second embodiment of the invention.
Figure 5B:
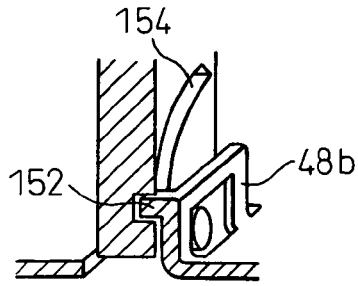
FIG. 5*b* is an enlarged perspective view of a portion "b" of FIG. 5*a;*

FIGS. 5*a* and 5*b* show a second embodiment of the invention. In the second embodiment, on the upper end of each guiding part 48*a*, 48*b* formed by punching and bending the support plate 12, a protrusion 152 (FIG. 5*b*) as a displacement restricting part is integrally formed. Further, on each arm 34 of the pair of link members 16, a curved groove 154 is formed which engages with the protrusion 152. The groove 154 is configured such that the protrusion 152 may smoothly slide in the groove 154 without slipping movement. Therefore, also in the second embodiment, the displacement in the rightward/leftward direction or the slipping movement of the key top 14 is prevented, while the key top 14 is lowered from the uppermost position to the lowermost position.

Figure 6:
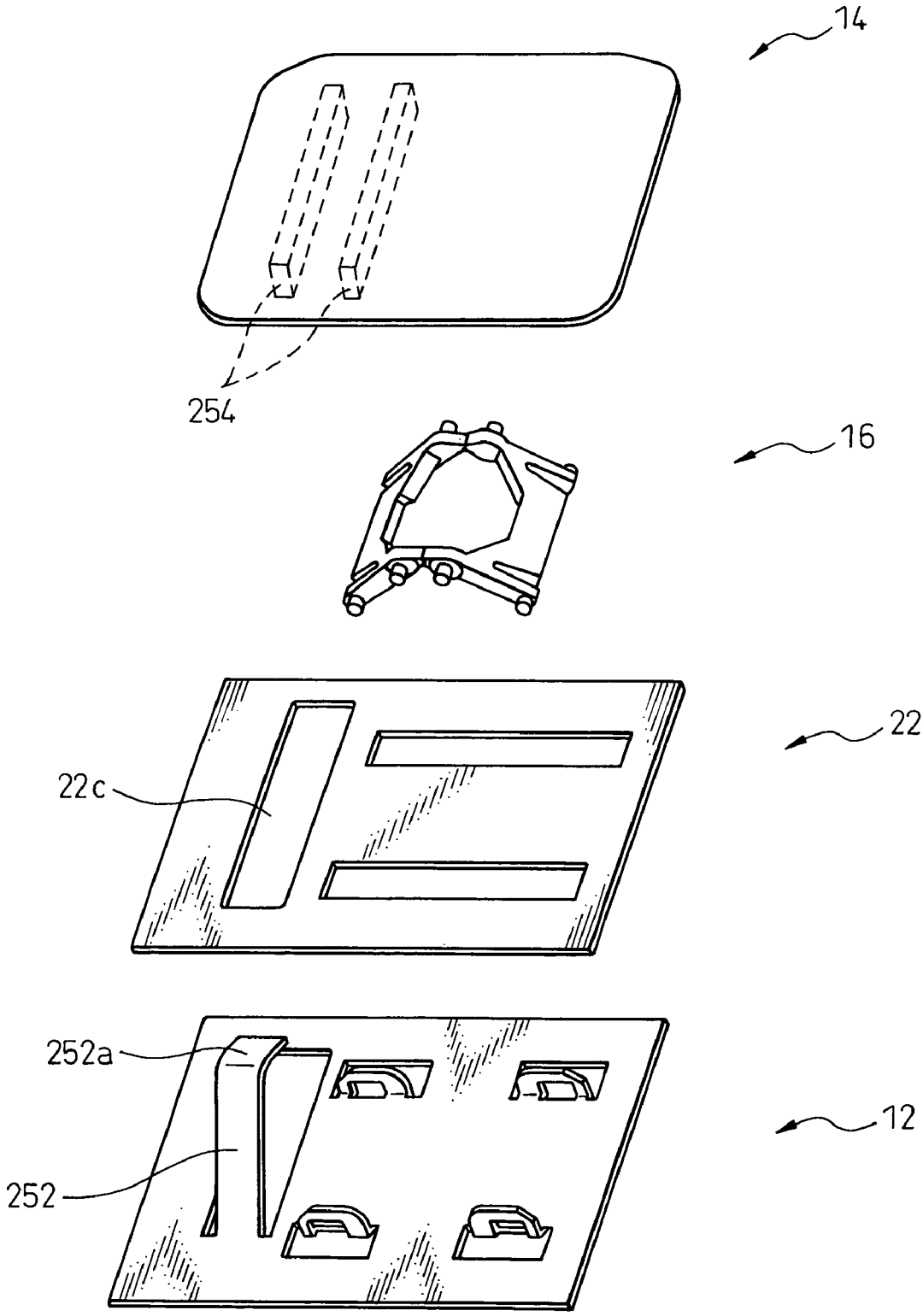
FIG. 6 is an exploded perspective view showing a key switch device according to a third embodiment of the invention.

FIG. 6 shows a third embodiment of the invention. In the third embodiment, a blade spring 252 as the displacement restricting part is formed by punching and bending a part of the support plate 12. Further, projections forming a pair of rails 254 are formed on the lower surface of the key top 14, so as to prevent the movement of an end 252*a* of the blade spring 252 relative to the key top in the sliding direction of the link member. An opening 22*c* is formed in the membrane sheet 22 through which the blade spring 252 may extend when assembling. The biasing force of the blade spring 252 is sufficient to always contact the end 252*a* of the spring 252 to the lower surface of the key top 14. As the distance between the two projections is generally equal to the width of the blade spring 252, the slipping movement of the key top 14 during vertical movement may be prevented.

Figure 7:
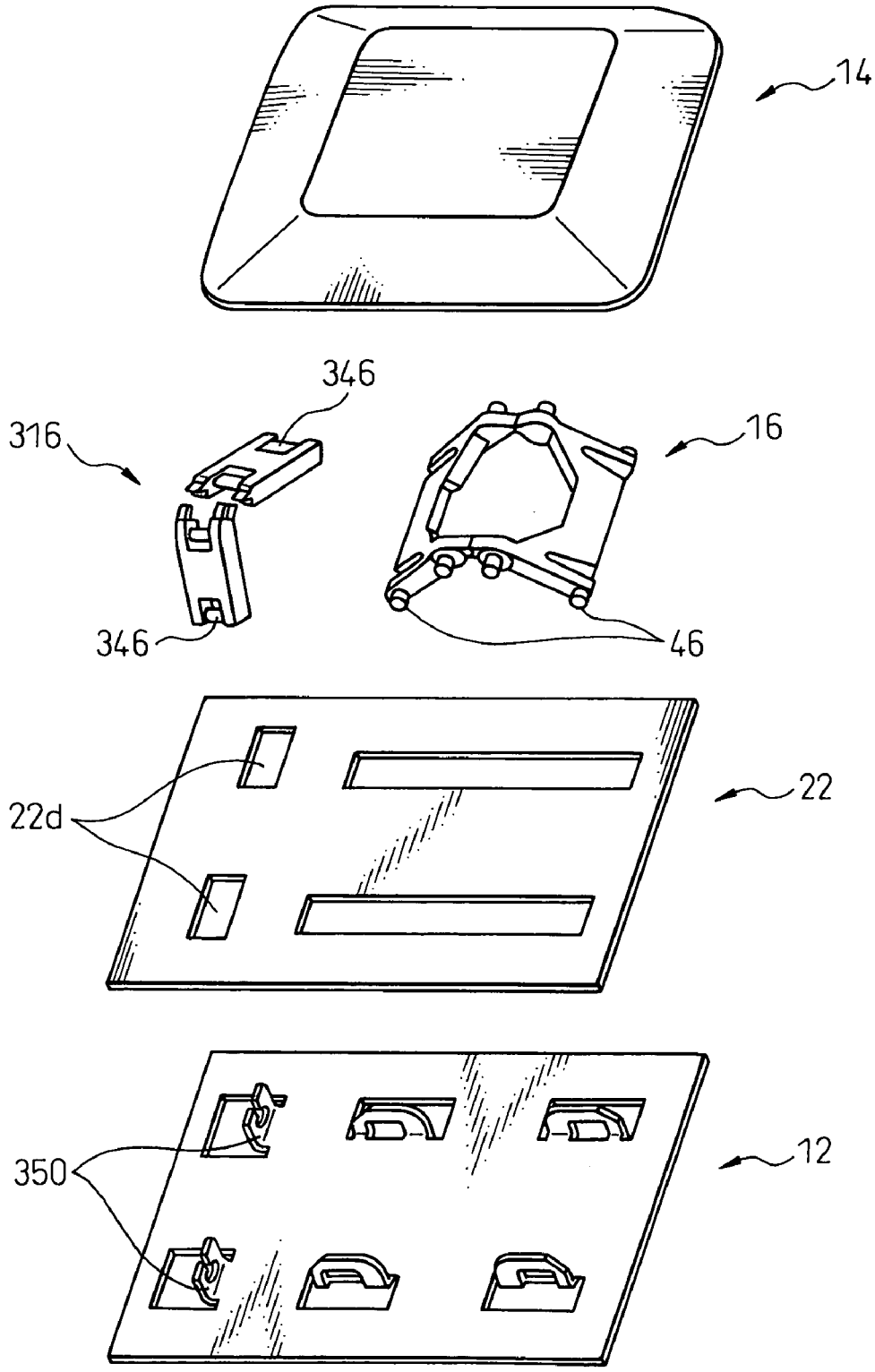
FIG. 7 is an exploded perspective view showing a key switch device according to a fourth embodiment of the invention.

FIG. 7 shows a fourth embodiment of the invention. In the fourth embodiment, in addition to the pair of link members 16, another pair of link members 316 is arranged as the displacement restricting part. The pair of link members 316 has a pair of sliding portions 346 capable of sliding on the upper surface 12*a* of the support plate 12 in the direction generally perpendicular to the sliding direction of the sliding part 46 of the link members 16. For the pair of link members 316, a guiding portion 350 is formed by punching and bending the support plate 12. Further, an opening 22*d* is formed in the membrane switch sheet 22 for the second link members 316 during assembly. As the second link members 316 may restrict the displacement of the key top 14 in the sliding direction of the sliding part 46, the undesired displacement of the key top 14 in any direction may be prevented.

Figure 8:
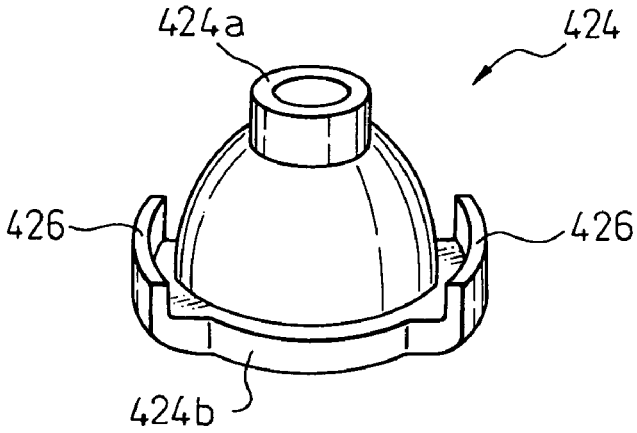
FIG. 8 is a perspective view of an actuating member of a key switch device according to a fifth embodiment of the invention.
Figure 9A:
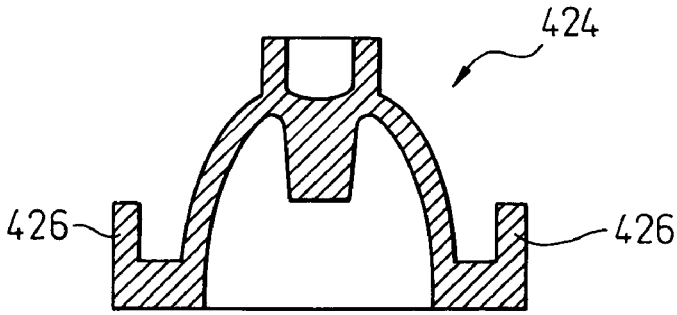
FIG. 9*a* is a sectional side view of the actuating member of FIG. 8.
Figure 9B:
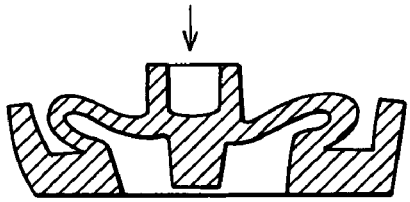
FIG. 9*b* is a sectional side view of the actuating member deformed by depressing the key top.
Figure 9C:
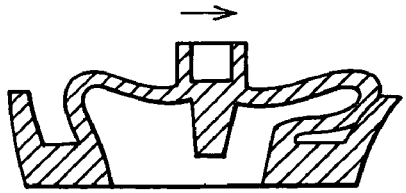
FIG. 9*c* is a sectional side view of the actuating member acting to avoid the displacement of the key top from the state of FIG. 9*b;*

FIG. 8 shows a fifth embodiment of the invention. In the fifth embodiment, in place of the actuating member 24 of the first embodiment, an actuating member 424 having a displacement restricting function. As shown in FIGS. 8 and 9*a*, the actuating member 424 has two displacement restricting parts or wall portions 426. The two wall portions 426 are integrally formed with a bottom portion 424*b* of the actuating member 424 and positioned on two sides of the bottom portion opposing in the sliding direction of the sliding part 46 of the link members 16. By such a constitution, as shown in FIG. 9*b*, when the key top (not shown) is depressed and the actuating member 424 is compressed, the displacement of the key top in the rightward/leftward direction (the rightward in this case) or the displacement of a top 424*a* of the actuating member 424 may be limited within a predetermined length, because the dome-shaped portion of the actuating member contacts the wall portion 426, as shown in FIG. 9*c*. As a result, the slipping movement of the key top may be prevented.

Figure 10A:
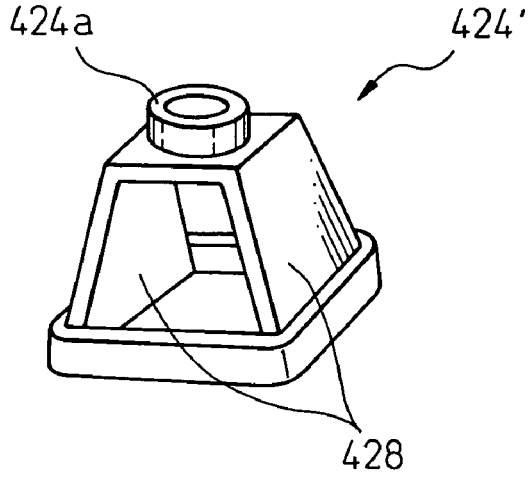
FIG. 10*a* is a perspective view of an alternative of the actuating member of FIG. 8.
Figure 10B:
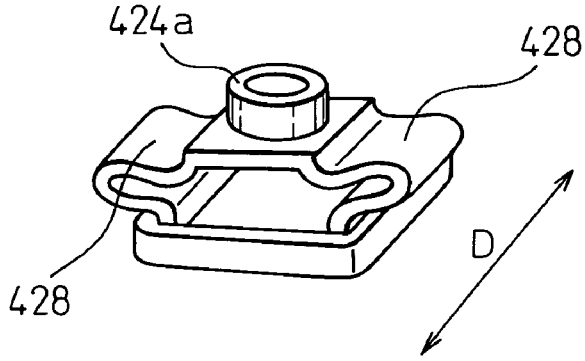
FIG. 10*b* is a perspective view of the actuating member of FIG. 10*a* which is compressed and deformed.
Figure 11:
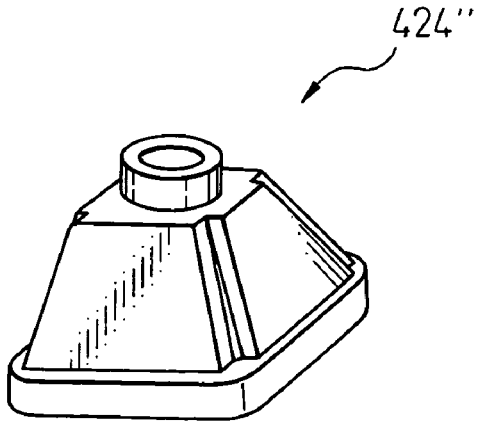
FIG. 11 shows a modification of the actuating member of FIG. 10*a;*

The same effect may be obtained by an actuating member 424', as shown in FIG. 10*a*, having the shape of a truncated pyramid two opposing side walls of which are removed. In this case, as shown in FIG. 10*b*, when the key top (not shown) is depressed, remaining two side walls 428 are compressed. By suitably adjusting the thickness of each side wall 428, the displacement of the top 424*a* of the actuating member 424' in the direction D may be prevented, whereby the displacement of the key top in the direction D may also be prevented. Therefore, when the actuating member 424' is arranged such that the direction D coincides with the sliding direction of the sliding part 46 of the link member 16, the slipping movement of the key top may be prevented. Further, as shown in FIG. 11, when the actuating member has a truncated pyramid 424" having all its side walls, it is unnecessary to take into account the orientation of the actuating member during assembly.

Figure 12:
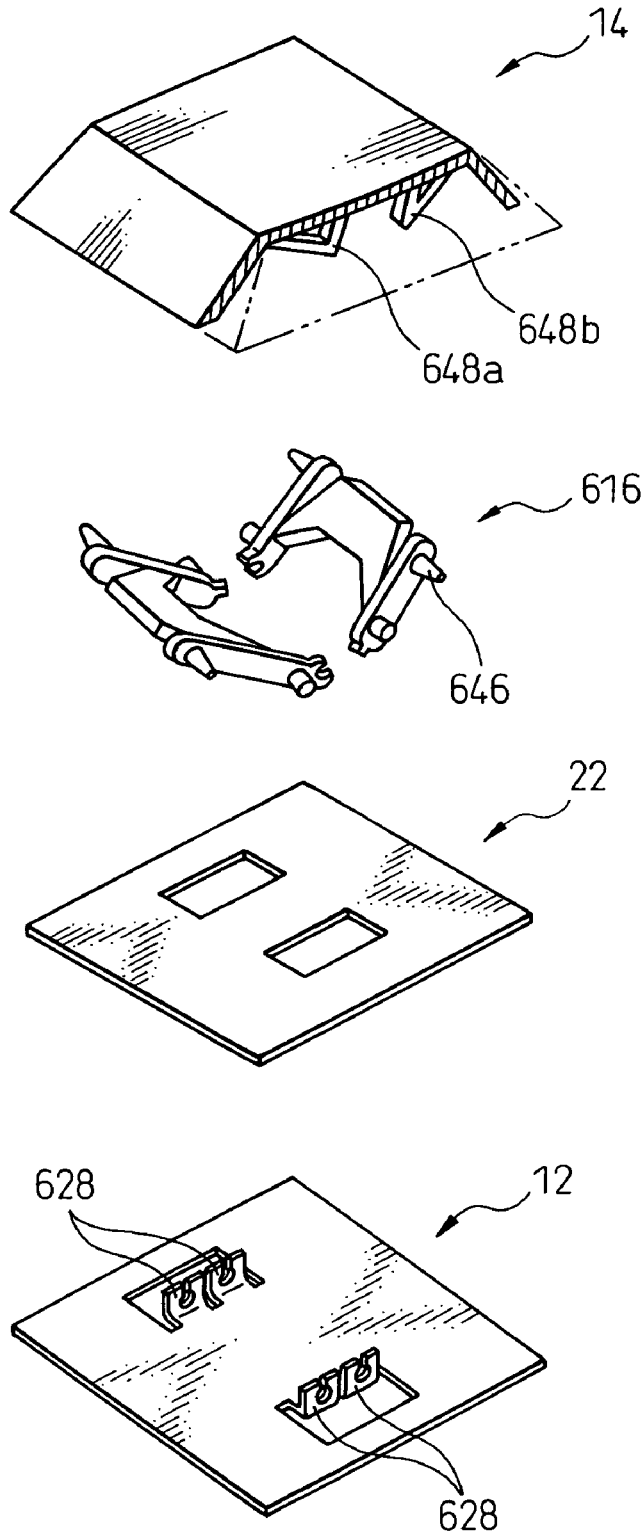
FIG. 12 is an exploded perspective view showing a key switch device according to a sixth embodiment of the invention.

FIG. 12 shows a sixth embodiment of the invention. In the sixth embodiment, a pair of link members 616 are assembled together into a V-shape, not a reverse V-shape, as seen in a lateral direction and, guiding parts 648*a* and 648*b* are arranged on the lower surface of the key top 14, not on the support plate 12. Instead, pivot-support sections 628 are formed by punching and bending the support plate 12.

Figure 13A:
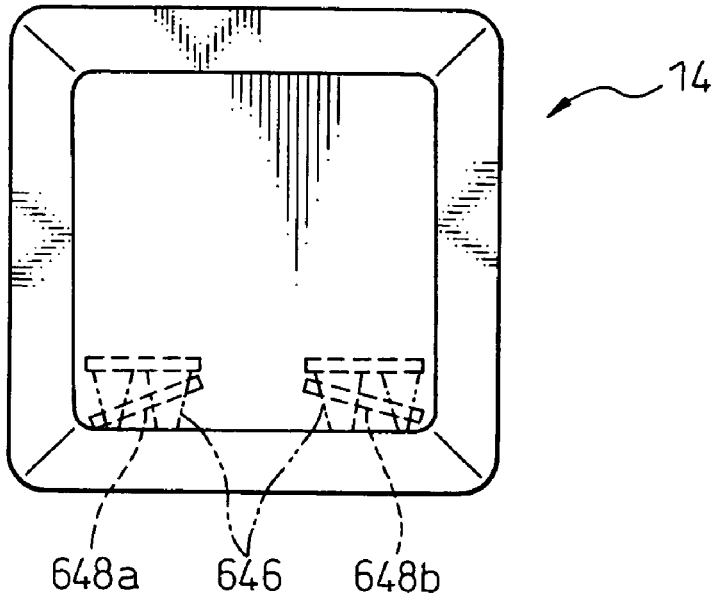
FIGS. 13*a* and 13*b* are a plan view and a side view, respectively, explaining the positional relation between a sliding part and a guiding part of a link member of FIG. 12.
Figure 13B:
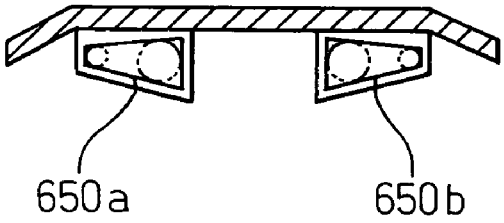

In the sixth embodiment, a sliding part 646 of the pair of link members 616 and the guiding parts 648*a* and 648*b* on the lower surface of the key top cooperatively constitute the displacement restricting parts. For example, as shown in FIG. 12, each sliding part 646 has the shape of a cone or a truncated cone, not a cylinder. In this case, as shown in FIG. 13*a*, the guiding parts 648*a* and 648*b* are arranged on the lower surface of the key top 14 in the direction not parallel to the sliding direction of the sliding part 646. Further, as shown in FIG. 13*b*, the widths of guiding grooves 650*a* and 650*b* of the guiding parts 648*a* and 648*b* are not constant as seen in the lateral direction and become narrower toward the outside of the key top. Due to this, even when the key top 14 is positioned between the uppermost and lowermost positions, the displacement of the sliding parts 646 in the sliding direction or the slipping movement of the key top may be prevented.

The feature of the sixth embodiment is that the widths of the guiding grooves 650*a* and 650*b* are not constant in the sliding direction of the sliding parts 646 and, further, the shape of a portion of each sliding part 646 engaging with the guiding grooves varies corresponding to the width of each guiding groove. Accordingly, in any position of the key top between the uppermost and lowermost positions, each sliding part 646 is not undesirably displaced relative to each guiding groove, whereby the slipping movement of the key top may be prevented.

Figure 14:
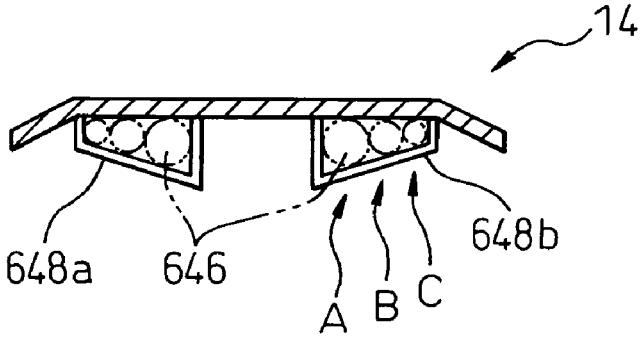
FIG. 14 is a side view, similar to FIG. 13*b*, showing another configuration of the guiding part.
Figure 15:
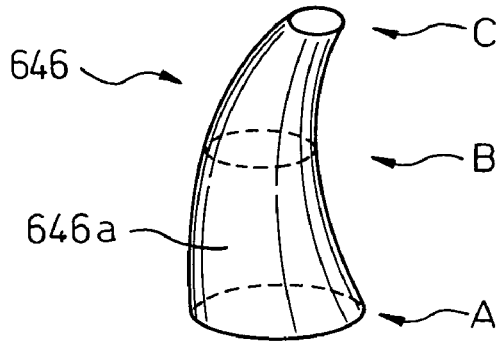
FIG. 15 shows the shape of the sliding part adapted to the guiding part.
Figure 16A:
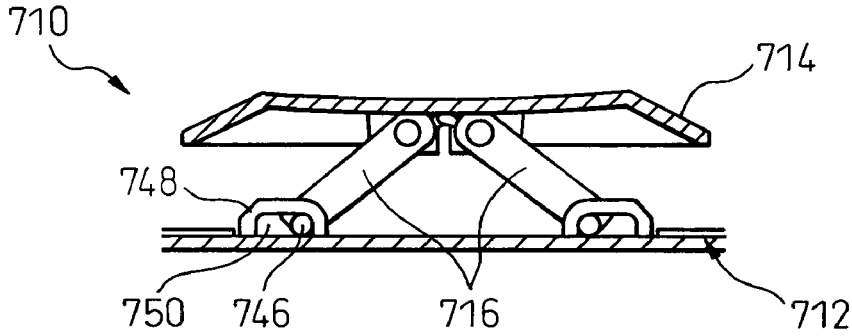
Fig.16a PRIOR ART
FIG. 16*a* is a side view showing a key top of a conventional key switch device at the uppermost position thereof.
Figure 16B:
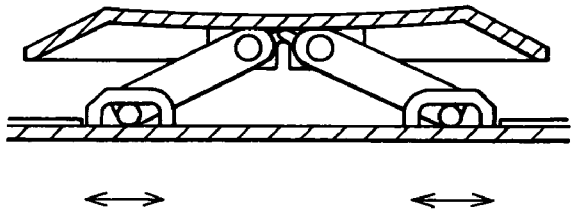
Fig.16b PRIOR ART
FIG. 16*b* is a side view showing the key top of FIG. 16*a* between the uppermost position and the lowermost position thereof.
Figure 16C:
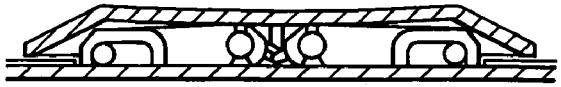
Fig.16c PRIOR ART
FIG. 16*c* is a is a side view showing the key top of FIG. 16 at the lowermost position thereof.

Also, as shown in FIG. 14, the guiding parts 648*a* and 648*b* may be configured more simply, i.e., the upper sides of the guiding grooves 650*a* and 650*b* coincide with the lower surface of the key top. In this case, by forming the sliding part 646 such that the shape of the sliding part is a cone or a truncated cone having a twisted side wall, as shown in FIG. 15, the displacement of the sliding parts 646 in the sliding direction may be prevented in any position of the key top between the uppermost and lowermost positions thereof. In other words, as the key top 14 is vertically moved, each sliding part 646 rolls in each groove and moves in the horizontal direction. Therefore, when each sliding part 646 has the shape as shown in FIG. 15, in any position of the key top between the uppermost and lowermost positions, each sliding part 646 may fittingly engage with the groove as shown in FIG. 14. For example, the portions A, B and C of the sliding part 646 as shown in FIG. 15, engaging with the guiding groove 650*b*, correspond to the positions A, B and C in the groove 650*b* as shown in FIG. 14, respectively.

In the above first to fifth embodiments of the invention, the pair of link members are assembled together into a reverse V-shape as seen in the lateral direction, on the other hand, in the sixth embodiment, the pair of link members are assembled together into a V-shape as seen in the lateral direction. However, it should be noted that various modifications may be possible within the scope of the invention, for example, the reverse V-shape may be changed to the V-shape in some cases.

According to the present invention, the slipping movement of the key top in the horizontal direction may be prevented during the key is being depressed. Further, wear or damage of the displacement restricting part therefor may be minimized.

The displacement restricting part may be formed by punching and bending of the support plate, whereby the key switch device may be thinned.

Alternatively, the displacement restricting part may be formed as another pair of link members. As one pair of link members may prevent the key top from displacing in one direction, the key switch device having two pair of link members may prevent the key top from displacing in any direction.

Alternatively, the displacement restricting part may be integrally formed with the actuating member, whereby punching and bending processes of the support plate is unnecessary.

Due to the combination of the sliding parts of the link members each having the shape of a cone or a truncated cone and the guiding grooves, each having varying width, with which the sliding parts engage, the displacement restricting function may be achieved.

The thickness of a keyboard having the key switch device of the invention may be reduced and it may be manufactured at low cost.

While the invention has been described with reference to specific embodiments chosen for the purpose of illustration, it should be apparent that numerous modifications could be made thereto, by one skilled in the art, without departing from the basic concept and scope of the invention.

The invention claimed is:

1. A key switch device comprising:

a support plate;

a key top arranged above the support plate;

a pair of link members interlocked to each other to support the key top above the support plate and direct the key top in a vertical direction; and a switch mechanism capable of opening and closing a contact section of an electric circuit in accordance with a vertical movement of the key top, wherein each of the pair of link members has a toothed end such that the link members are assembled together into a reverse V-shape as seen in a lateral direction, and a sliding part is slidably engaged with the support plate, wherein the switch mechanism includes a membrane switch sheet carrying the contact section at a position corresponding to the key top and placed on the support plate, wherein the support plate has a displacement restricting part arranged on the support plate, wherein each of the pair of link members has an engaging part configured to contact the displacement restricting part at any time during the vertical movement of the key top, whereby the displacement of the key top in the sliding direction of the sliding part of each of the pair of link members is restricted, and wherein each of the pair of link members has two arm portions and a body portion coupling the two arm portions, and the engaging part includes a curved concave portion and a curved convex portion formed on the body portion.

2. The key switch device as set forth in claim 1, wherein the support plate is made from a metal plate and wherein the displacement restricting part is formed by punching and bending a part of the metal plate and has a curved surface contacting the engaging portion of each of the pair of link members.

3. The key switch device as set forth in claim 1, wherein the support plate is made from a metal plate and wherein the displacement restricting part is formed by punching and bending a part of the metal plate and has an arc-shaped cut surface contacting the engaging portion of each of the pair of link members.

4. The key switch device as set forth in claim 1, wherein the convex portion of the engaging part has a cross section of a part of an ellipse as seen in the lateral direction, and wherein the displacement restricting part has a curved surface having an arc-shaped cross section as seen in the lateral direction.

5. The key switch device as set forth in claim 1, wherein the engaging part is formed on either side of the body portion of each of the pair of link members.

6. A key board having a plurality of key switch devices as set forth in claim 1.

7. A key switch device comprising:

a support plate;

a key top arranged above the support plate;

a pair of link members interlocked to each other to support the key top above the support plate and direct the key top in a vertical direction; and a switch mechanism capable of opening and closing a contact section of an electric circuit in accordance with a vertical movement of the key top, wherein each of the pair of link members has a toothed end such that the link members are assembled together into a reverse V-shape as seen in a lateral direction, and a sliding part is slidably engaged with the support, wherein the switch mechanism includes a membrane switch sheet carrying the contact section at a position corresponding to the key top and placed on the support plate, wherein the support plate has a displacement restricting part arranged on the support, plate wherein each of the pair of link members has an engaging part configured to contact the displacement restricting part at any time during the vertical movement of the key top, whereby the displacement of the key top in the sliding direction of the sliding part of each of the pair of link members is restricted, and wherein the support plate is made from a metal plate and the displacement restricting part is formed by punching and bending a part of the metal plate, and wherein the displacement restricting part has a protrusion slidably engaged with a groove formed on each of the pair of link members.

8. The key switch device as set forth in claim 7, wherein the protrusion is formed by bending a part of the displacement restricting part formed by punching and bending a part of the metal plate.

9. A key board having a plurality of key switch devices as set forth in claim 7.

10. A key switch device comprising:

a support plate;

a key top arranged above the support plate;

a pair of link members interlocked to each other to support the key top above the support plate and direct the key top in a vertical direction; and a switch mechanism capable of opening and closing a contact section of an electric circuit in accordance with a vertical movement of the key top, wherein each of the pair of link members has a toothed end such that the link members are assembled together into a reverse V-shape as seen in a lateral direction, and a sliding part is slidably engaged with the support plate, wherein the switch mechanism includes a membrane switch sheet carrying the contact section at a position corresponding to the key top and placed on the support plate, wherein the support plate has a blade spring arranged on the support plate and having an end biased against the key top so as to always contact a lower face of the key top, and wherein the key top has a pair of guide rails on the lower face thereof, a distance between the two guide rails being generally equal to a width of an end of the blade spring, for guiding the end of the blade spring such that a movement of the sliding part in a sliding direction thereof relative to the key top is restricted.

11. The key switch device as set forth in claim 10, wherein the blade spring is formed by punching and bending a part of the support plate.

12. A key board having a plurality of key switch devices as set forth in claim 10.

13. A key switch device comprising:

a support plate;

a key top arranged above the support plate;

a first pair of link members interlocked to each other to support the key top above the support plate and direct the key top in a vertical direction; and a switch mechanism capable of opening and closing a contact section of an electric circuit in accordance with a vertical movement of the key top, wherein each of the first pair of link members has a toothed end such that the first link members are assembled together into a reverse V-shape as seen in a lateral direction, and a sliding part is slidably engaged with the support plate, wherein the switch mechanism includes a membrane switch sheet carrying the contact section at a position corresponding to the key top and placed on the support plate, and wherein the key switch device further comprises a second pair of link members having a second sliding part slidably engaged with the support plate such that the second sliding part may move relative to the support plate in the direction generally perpendicular to the sliding direction of each sliding part of the first pair of link members.

14. A key board having a plurality of key switch devices as set forth in claim 13.

15. A key switch device comprising:

a support plate;

a key top arranged above the support plate;

a first pair of link members interlocked to each other to support the key top above the support plate and direct the key top in a vertical direction; and a switch mechanism capable of opening and closing a contact section of an electric circuit in accordance with a vertical movement of the key top, wherein each of the first pair of link members has a toothed end such that the first link members are assembled together into a reverse V-shape as seen in a lateral direction, and a sliding part is slidably engaged with the support plate, wherein the switch mechanism includes a membrane switch sheet carrying the contact section at a position corresponding to the key top and placed on the support plate, and wherein the switch mechanism comprises an actuating member arranged between the key top and the membrane switch sheet and configured to close the contact when the key top is downwardly moved, the actuating member having a displacement restricting part for limiting the displacement of the top of the actuating member in the sliding direction of the sliding part.

16. The key switch device as set forth in claim 15, wherein the displacement restricting part is a wall portion integrally formed on the bottom of the actuating member.

17. The key switch device as set forth in claim 15, wherein the actuating member has the shape of a truncated pyramid.

18. The key switch device as set forth in claim 15, wherein the actuating member has the shape of a truncated pyramid the two side walls of which, opposing in the sliding direction of the sliding part, are removed.

19. A key board having a plurality of key switch devices as set forth in claim 15.

20. A key switch device comprising:

a support plate;

a key top arranged above the support plate;

a first pair of link members interlocked to each other to support the key top above the support plate and direct the key top in a vertical direction; and a switch mechanism capable of opening and closing a contact section of an electric circuit in accordance with a vertical movement of the key top, wherein each of the first pair of link members has a toothed end such that the first link members are assembled together into a V-shape as seen in a lateral direction, and a sliding part is slidably engaged with a guiding section arranged on the lower surface of the key top, wherein the switch mechanism includes a membrane switch sheet carrying the contact section at a position corresponding to the key top and placed on the support plate, and wherein the guiding section on the lower surface of the key top has a guiding groove the width of which is not constant along the sliding direction of the sliding part, the sliding part being configured such that the shape of the cross section of a part of the sliding part engaging with the guiding groove is changed corresponding to the width of the guiding groove.

21. The key switch device as set forth in claim 20, wherein the sliding part has the shape of a circular cone or a truncated cone.

22. The key switch device as set forth in claim 20, wherein the sliding part has the shape of a circular cone or a truncated cone a side wall of which is twisted.

23. A key board having a plurality of key switch devices as set forth in claim 20.

* * * * *